United States Patent [19]

Weber

[11] 4,166,028

[45] Aug. 28, 1979

[54] APPARATUS FOR SCREENING PAPER FIBER STOCK

[75] Inventor: Arnulf E. M. Weber, Cauderan, France

[73] Assignee: The Black Clawson Company, Middletown, Ohio

[21] Appl. No.: 688,335

[22] Filed: May 20, 1976

[51] Int. Cl.[2] ..... B07B 1/20

[52] U.S. Cl. ..... 209/273; 209/306

[58] Field of Search ..... 209/17, 211, 250, 305, 209/306, 273

[56] References Cited

U.S. PATENT DOCUMENTS

| | | | |
|---|---|---|---|
| 2,347,716 | 5/1944 | Staege | 209/273 |
| 2,849,117 | 8/1958 | Rietema | 209/211 |
| 3,145,165 | 8/1964 | Sandison | 209/254 |
| 3,159,572 | 12/1964 | Ranhagen | 209/273 |
| 3,255,883 | 6/1966 | Nelson et al. | 209/17 |
| 3,363,759 | 1/1968 | Pouhder | 209/306 |
| 3,400,820 | 9/1968 | Nelson | 209/306 |
| 3,458,038 | 7/1969 | Young | 209/306 |
| 3,680,696 | 8/1972 | Morin | 209/273 |
| 3,970,548 | 7/1976 | Seifert | 209/306 |

*Primary Examiner*—Hiram H. Bernstein

*Attorney, Agent, or Firm*—Biebel, French & Nauman

[57] ABSTRACT

In screening apparatus for paper fiber stock of the type wherein a cylindrical perforate screen member defines screening and accepts chamber on the inner and outer sides thereof in a closed housing, the inlet chamber for stock to be screened is located below the screening chamber, and the reject chamber for accumulating reject material is located above the screening chamber. Provision is made for retaining high specific gravity materials within the inlet chamber and for trapping and removing them therefrom without ever reaching the screen chamber. In addition, provision is made for developing centrifugal force effective to concentrate low specific gravity materials, such as bits of plastic foam, in the central part of the reject chamber, and a discharge outlet from the reject chamber located generally centrally of its top wall assures elimination of such light reject materials.

8 Claims, 4 Drawing Figures

APPARATUS FOR SCREENING PAPER FIBER STOCK

BACKGROUND OF THE INVENTION

Paper mills have for many years made extensive use, for the screening of paper making stock, of screen apparatus embodying a cylindrical perforate screen member defining screening and accepts chambers on the opposite sides thereof in a closed housing and provided with a rotor member which operates in one of the chambers to keep the screen perforations open and free from solid materials tending to cling to the screen surface. Commonly, the stock or furnish is delivered to the screening chamber adjacent the end of the screen member, and the material rejected by the screen member is collected and discharged from the opposite end of the screen member.

The assignee of this invention has manufactured and sold many such screens, originally in accordance with Staege U.S. Pat. No. 2,347,716, and more recently in accordance with Martindale U.S. Pat. No. 2,835,173, the latter construction being characterized by a rotor comprising bars or vanes of air-foil section in closely spaced but non-contacting relation with the surface of the screen member. Similar screens have been marketed for some years in competition with those of the assignee of this invention, in accordance with other patents such, for example, as Cannon et al U.S. Pat. No. 2,975,899, Lamort U.S. Pat. No. 3,617,008 and Holz U.S. Pat. No. 3,581,983.

The art has also experimented widely with detailed variations in screens of the above type, including variations in the size, spacing and configuration of the perforations in the screen member and also in the vane shape and in other forms of rotor. For example, such screens have been offered in recent years wherein the rotor is a drum-like member provided with multiple bumps or other offset portions over its surface. Typical such constructions are shown in Clarke-Pounder U.S. Pat. No. 3,363,759 and Bolton et al U.S. Pat. No. 3,726,401.

SUMMARY OF THE INVENTION

In accordance with the present invention, it has been observed that in all of the vertically oriented commercial screens of the type outlined above, the primary direction of through flow is downwardly, with the stock entering the screen chamber from above, or in some cases centrally of the screening chamber when the direction of screening is from the outside to the inside of the screen member, so that any high specific gravity reject material entrained with the stock to be screened will travel by gravity to a reject discharge chamber in the lower part of the screen, from which it is subsequently discharged. Necessarily, therefore, there is substantial opportunity for such reject material to damage the perforate screen member as it travels through the screening chamber, especially with screens of the type wherein the screening chamber is on the inside of the perforate screen member, and wherein centrifugal force therefore will cause high specific gravity materials to travel along the screening surface.

Another type of reject material, which is becoming increasingly prevalent in waste paper stocks, is material of lower specific gravity than the paper fibers, such for example as pieces of plastic, especially scraps of plastic foam. The circulatory movement imparted to the stock in the screening chamber by whatever rotor is used will develop centrifugal force which will tend to cause such light materials to migrate toward the center of the screening and reject chambers. However, in order to discharge these concentrated light reject materials, it is necessary for them to overcome the gravitational forces which tend to cause them to rise within the apparatus and therefore away from the reject discharge outlet.

The primary object of the present invention is to provide a pressure screen of the general type outlined above wherein the supply flow of stock to be screened enters the apparatus by way of an inlet chamber located entirely below the screening chamber, and wherein low specific gravity reject materials, including materials of substantially the same specific gravity as accepted fiber, are collected in a reject chamber above the screening chamber, and from which they are discharged by a port located generally centrally of the top wall of the apparatus in order to insure effective removal of light reject materials of the types discussed above. This arrangement of inlet and reject outlets ports also insures that the screening chamber is filled with stock essentially free of air pockets, since any air entrained with the entering stock will rise to the reject chamber and escape through the reject port.

In addition, the inlet and screening chambers are constructed to provide an annular space in the inlet chamber which is of greater outer diameter than the flow passage through which the stock enters the screening chamber, and sufficient centrifugal force is developed in the inlet chamber to cause high specific gravity reject materials, such as tramp metal and the like, to be collected in this annular space and thereby prevented from coming in contact with the screen member. Such trapped high specific gravity materials are discharged from time to time directly from this annular space, so that only materials of approximately the same specific gravity as paper fiber or a lower specific gravity are allowed to reach the screening chamber.

The operation of a preferred form of screening apparatus in accordance with the invention also incorporates a rotor of special construction which will promote concentration of low specific gravity materials in the center of the reject chamber, and also movement to the reject chamber of particles similar in specific gravity to paper fibers but too large to pass through the perforations of the screen member. This rotor construction includes vanes which travel close to the inner surface of the screen member and are inclined with respect to the rotor axis to impart an upward flow component to particles in the space between themselves and the screen member. The rotor also may include paddle-like arms which support these vanes and act like propellers to increase the circulatory flow of the stock as it passes through the screening chamber.

DESCRIPTION OF THE PREFERRED EMBODIMENT

Figure 1:
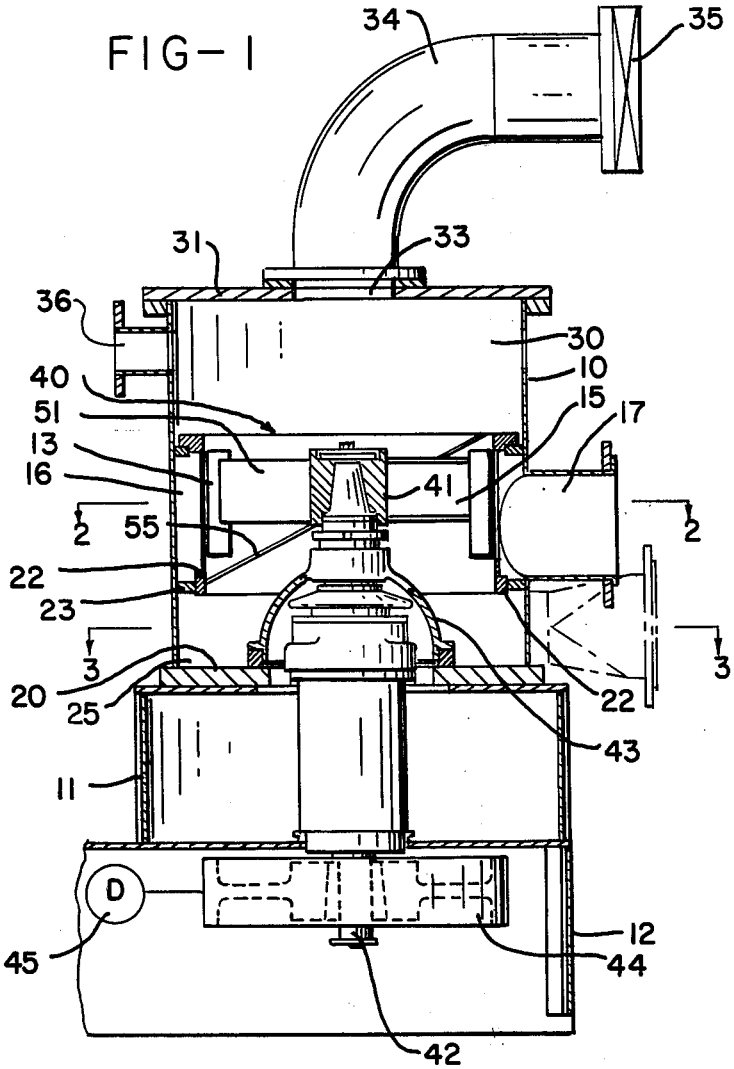
FIG. 1 is a vertical section, taken approximately on the line 1—1 of FIG. 3, showing screening apparatus in accordance with the invention.
Figure 2:
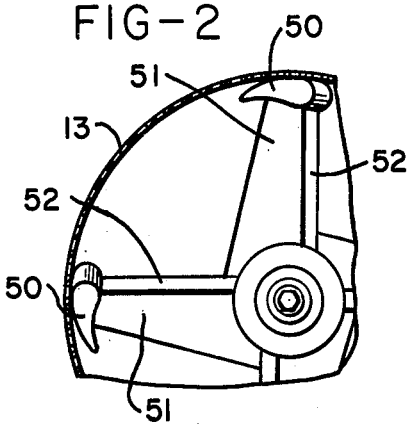
FIG. 2 is a fragmentary section on the line 2—2 of FIG. 1.
Figure 3:
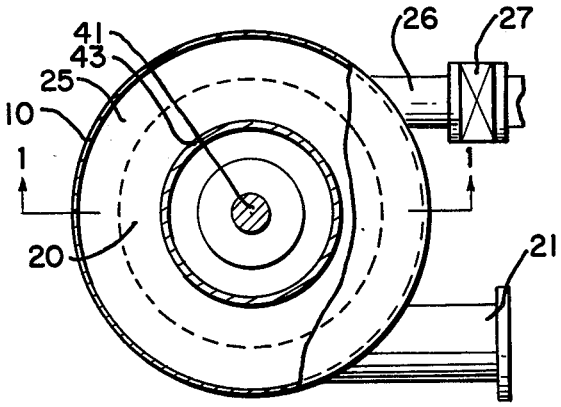
FIG. 3 is a fragmentary section on the line 3—3 of FIG. 1.

The screening apparatus shown in the drawing comprises a main housing 10 of cylindrical horizontal section mounted by a stand 11 on a base 12. A cylindrical perforate screen member 13 divides the central portion of the interior of the housing into a screening chamber 15 and an annular accepts chamber 16 having a radially arranged outlet port 17. The screen member 13 is provided with multiple perforations which may be of any conventional shape, size and spacing, a typical example being circular holes 0.062 inch in diameter and in such spacing as to provide an open area in the range of 10–15%. Alternatively, these perforations may comprise slots of the sizes and spacings disclosed in Seifert U.S. Pat. No. 3,849,302.

Below the screen member 13 is the inlet chamber 20, to which stock to be screened is supplied by a tangential inlet port 21. The screen member 13 includes a lower rim 22 which is of smaller inner diameter than the housing 10 and defines the flow passage by which stock enters the screening chamber 15 from inlet chamber 20. The rim 22 is centered in the housing by an annular spacer 23 and cooperates therewith to define an annular space 25 which extends around the outside of the inlet chamber 20 and has an inner diameter equal to that of rim 22.

The tangential entry of the stock through the inlet port 21 creates centrifugal force effective to carry high specific gravity materials, e.g. tramp metal, into this space 25 where it is retained by the rim 22 and spacer 23 against entry to the screening chamber 15. A discharge port 26 is tangentially arranged in the opposite direction from inlet port 21 and spaced to act as a collection boot for trapping such reject material, which is readily discharged therefrom by a valve 27 periodically or intermittedly opened as the occasion may require.

The uppermost section of the housing 10 encloses a reject chamber 30 for accumulating solid materials which are not accepted by the screen member 13. A removable cover plate 31 forms the top wall of the reject chamber 30 and is provided with a centrally located discharge port 33 of relatively large diameter, e.g. 4 to 8 inches for a housing 10 which is 24 inches in diameter. The discharge pipe 34 from port 33 is preferably provided with an intermittedly operable control valve 35. In addition, the chamber 30 is provided with one or more inlet ports 36 for dilution water as described hereinafter.

Within the screening chamber 16 is a rotor assembly indicated generally at 40 and including a hub 41 secured to the upper end of a drive shaft 42 mounted on a bell-shaped seal and support bracket 43 and provided at its lower end with drive means shown as a sheave 44 and drive 45. The rotor assembly 40 is shown as constructed generally in accordance with Seifert et al application Ser. No. 582,867, filed June 2, 1975, now U.S. Pat. No. 3,970,548 and includes four vanes or bars 50 of generally the same helical configuration as in the above Martindale patent.

Each of the vanes 50 is mounted on the rotor hub 41 by an arm 51 of generally channel shape and substantial axial extent, e.g. an axial dimension of the order of five inches in a screen wherein the axial dimension of the screen cylinder is twelve inches. In addition, the arms 51 are preferably so constructed and arranged that their central portions are inclined forwardly and upwardly in their direction of rotation so that the leading surfaces 52 of the arms form propeller blades for accentuating the circulatory movement of the stock in the screening chamber 15 and also imparting axially upward movement to this circulating stock. Vane-supporting arms of other types also may be used, such, for example, as the rod members shown in the above Martindale patent.

In operation, the stock to be screened is supplied to the inlet chamber 20 through inlet port 21 at sufficient velocity, e.g. 600–900 feet per minute, to develop enough centrifugal force within the inlet chamber to cause any high specific gravity contaminant materials to travel directly to and around the peripheral wall of chamber 20, with the result that they will be concentrated in the annular space 25 and quickly be trapped in the reject port or boot 26. None of this high specific gravity material will therefore be able to enter the screening chamber through the flow passage defined by the rim 22 of screen member 13.

The action of the rotor assembly 40 will have a member of effects on reject material. It will intensify the action of centrifugal force in both the screening chamber 15 and reject chamber 30 in causing light rejects to concentrate and rise into the central part of the reject chamber 30, this effect being enhanced if the vane supporting arms 51 are constructed as shown to provide a propeller action. At the same time, the vanes 50 will function in their usual way cause the stock to circulate in a vortical pattern causing the solids therein to be swept repeatedly over the surface of screen member 13, and also to produce pressure pulses through the perforations in screen member 13 for the purpose of dislodging particles too large to pass therethrough.

The inclination of vanes 50 imparts an upward component of movement to such dislodged particles which may be aided by one or more optional spiral ribs 55 extending along the inner surface of screen member 13. Generally speaking, preferred results are obtained in this respect when each vane 50 and rib 55 cross each other at approximately right angles, as indicated in FIG. 1. It should also be noted that since the invention effectively minimizes the possibility that metal or other hard particles can reach the screening chamber, it is possible to design the vanes 50 and to adjust their spacing with respect to the rib or ribs 55 in such manner as to take maximum advantage of the slushing and defibering action which these parts can have on fiber bundles and the like in the stock being screened.

Under these operating conditions, the reject material travels upwardly to the reject chamber 30, with the light reject fraction concentrated in the central part of the chamber, since the circulatory movement imparted to the stock by the rotor assembly will continue into chamber 30, and with the oversized reject particles of higher specific gravity in the remainder of chamber 30. The discharge flow through reject discharge port 33 is controlled in accordance with the desired operating conditions of the screen to provide a continuous or intermitent bleed carrying the reject materials with it. Continuous effective purging of reject material from chamber 30 is also promoted by admission of dilution water through the port or ports 36.

Figure 4:
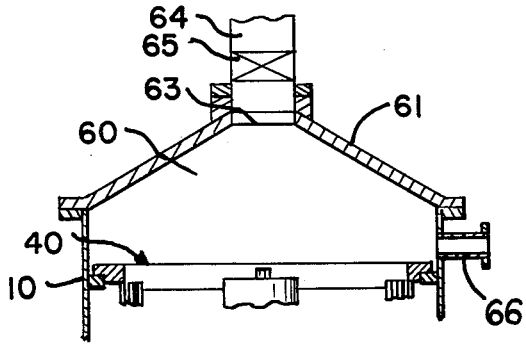
FIG. 4 is a fragmentary section similar to FIG. 1 showing a modified construction of the top portion of the apparatus.

FIG. 4 shows a modified construction for the reject chamber of the screening apparatus which is especially useful if the feed stock to the screen is at relatively high consistency, e.g. 2% solids or more. The reject chamber 60 has a dome-shaped cover plate 63 which includes at its upper end the outlet port 63. In addition, the discharge pipe 64 leads straight up from the cover plate 61 and is provided with a control valve 65 in its vertical portion close to the cover plate.

The construction of FIG. 4 offers two advantages, the first being that the domed shape of the cover plate acts as a funnel so that under the pressure conditions of operation, all reject material which reaches the chamber 60 will continue to travel upwardly to its outlet port 63. This effect can be obtained with the cover plate 61 frustoconical, as shown, or bell shaped. In addition, the relatively small size of port 63 and pipe 65 provides a sufficiently high velocity flow for the discharge of reject material to minimize the possibility of plugging such as could occur under some conditions with a larger port and pipe. If desired, the reject chamber 60 can also be provided with one or more ports for dilution water, as indicated at 66.

What is claimed is:

1. Screening apparatus for paper fiber stock comprising:

(a) a generally cylindrical vertical housing, (b) means defining an inlet chamber in the lower end of said housing and including a tangentially arranged stock inlet port to said chamber, (c) screen means including a cylindrical perforate screen member supported in an intermediate portion of said housing above said inlet chamber and separating said portion into a screening chamber and an annular accepts chamber on the inner and outer sides of said screen member respectively, (d) means cooperating with said inlet chamber to receive and retain high specific gravity materials entering through said stock inlet, (e) reject outlet means for discharging such retained high specific gravity materials from said inlet chamber, (f) means defining a reject chamber above said screening chamber for receiving reject materials therefrom, (g) rotor means mounted for rotation in said screening chamber and including a hub having vane means mounted thereon in angularly spaced relation, (h) means for driving said rotor means to accentuate circulatory movement of the stock in said screening and reject chambers and concentration of materials of lower specific gravity than paper fibers in the central portion of said reject chamber, (i) top wall means for said reject chamber, and (j) means defining an outlet port located generally centrally of said top wall means for discharge of reject materials from said reject chamber.

2. Screening apparatus as defined in claim 1 wherein said means (d) comprise means defining an inlet flow passage to said screening chamber from said inlet chamber which is of smaller inner diameter than said inlet chamber to provide an annular space around the periphery of said inlet chamber wherein high specific gravity materials entering through said stock inlet port are concentrated by the centrifugal force developed in the tangentially entering stock.

3. Screening apparatus as defined in claim 2 wherein said reject outlet means includes a port tangentially arranged in the opposite orientation from said inlet port to remove and trap such high specific gravity materials.

4. Screening apparatus as defined in claim 1 wherein said rotor means includes vane means arranged to impart upward movement to said reject chamber of particles too large for passage through said screen member.

5. Screening apparatus as defined in claim 1 wherein said rotor means includes a hub, a plurality of vanes located in closely inwardly spaced relation with the inner surface of said screen member, and an essentially imperforate arm supporting each said vane on said hub member, each said arm presenting a leading surface functioning as a blade causing continuous circulatory movement of stock in said screening chamber.

6. Screening apparatus as defined in claim 5 wherein said arms and said vanes are inclined with respect to the axis of said rotor means to introduce an axial component into the circulatory movement of the stock in said screening chamber to promote movement to said reject chamber of low specific gravity materials and other reject materials too large for passage through said screen member.

7. Screening apparatus as defined in claim 1 further comprising means defining an inlet port to said reject chamber for admission of liquid to dilute reject material accumulating in said reject chamber and thereby to facilitate discharge thereof through said outlet port.

8. Screening apparatus as defined in claim 1 wherein said top wall means comprises a dome-shaped top wall for funneling the contents of said reject chamber to said reject outlet port.

* * * * *